US010194229B2

(12) United States Patent
Toelle et al.

(10) Patent No.: US 10,194,229 B2
(45) **Date of Patent: *Jan. 29, 2019**

(54) HEADPHONES WITH ADAPTABLE FIT

(71) Applicant: Google LLC, Mountain View, CA (US)

(72) Inventors: Haley Toelle, Oakland, CA (US); Jianchun Dong, Palo Alto, CA (US); Michael Kai Morishita, Belmont, CA (US); Eliot Kim, Los Gatos, CA (US); Hayes Solos Raffle, Palo Alto, CA (US); Livius Dumitru Chebeleu, San Jose, CA (US)

(73) Assignee: Google LLC, Mountain View, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/443,142

(22) Filed: Feb. 27, 2017

(65) Prior Publication Data

US 2017/0171656 A1 Jun. 15, 2017

Related U.S. Application Data

(63) Continuation of application No. 14/939,503, filed on Nov. 12, 2015, which is a continuation of application
(Continued)

(51) Int. Cl.
*H04R 1/02* (2006.01)
*H04R 1/10* (2006.01)
*H04R 5/033* (2006.01)

(52) U.S. Cl.
CPC ..... *H04R 1/1033* (2013.01); *H04R 1/1016* (2013.01); *H04R 1/1058* (2013.01);
(Continued)

(58) Field of Classification Search
CPC .. H04R 1/1016; H04R 1/1008; H04R 1/1066; H04R 5/033; H04R 1/1033; H04R 1/105; H04R 1/1058; H04R 1/1025
(Continued)

(56) References Cited

U.S. PATENT DOCUMENTS 1,668,890 A 5/1928 Curran et al.
1,668,910 A 5/1928 Jones
(Continued)

FOREIGN PATENT DOCUMENTS

CN 2449439 Y 9/2001
CN 1788523 A 6/2006
(Continued)

OTHER PUBLICATIONS

Wanstonic Electronic LTD ER-IIII Hi-Res Audio Earphone (Year: 2016).*
(Continued)

*Primary Examiner* — Matthew A Eason
*Assistant Examiner* — Julie X Dang
(74) *Attorney, Agent, or Firm* — Lerner, David, Littenberg, Krumholz & Mentlik, LLP

(57) ABSTRACT

A wearable audio component includes a first cable and an audio source in electrical communication with the first cable. A housing defines an interior and an exterior, the audio source being contained within the interior thereof. The exterior includes an ear engaging surface, an outer surface, and a peripheral surface extending between the front and outer surfaces. The peripheral surface includes a channel open along a length to surrounding portions of the peripheral surface and having a depth to extend partially between the front and outer surfaces. A portion of the channel is covered by a bridge member that defines an aperture between and open to adjacent portions of the channel. The cable is connected with the housing at a first location disposed within the channel remote from the bridge member and is captured in so as to extend through the aperture in a slidable engagement therewith.

18 Claims, 7 Drawing Sheets

Related U.S. Application Data

No. 14/143,687, filed on Dec. 30, 2013, now Pat. No. 9,241,209.

(60) Provisional application No. 61/839,186, filed on Jun. 25, 2013.

(52) U.S. Cl.
CPC ..... *H04R 1/1066* (2013.01); *H04R 1/028* (2013.01); *H04R 1/1008* (2013.01); *H04R 5/033* (2013.01); *H04R 2420/09* (2013.01)

(58) Field of Classification Search
USPC ..... 381/380–389
See application file for complete search history.

(56) References Cited

U.S. PATENT DOCUMENTS 1,953,437 A 4/1934 Schier
D102,655 S 1/1937 Nicholides
2,474,135 A 6/1949 White
2,619,960 A 12/1952 Reynolds
2,910,679 A 10/1959 Baldwin
2,971,065 A 2/1961 Busse
3,034,320 A 5/1962 Feibelman
3,049,582 A 8/1962 Shinn
3,324,253 A 6/1967 Uemura et al.
3,440,365 A 4/1969 Bryant et al.
3,712,409 A 1/1973 Kizakisz et al.
3,789,164 A 1/1974 Ryder
4,133,984 A 1/1979 Akiyama
4,457,396 A 7/1984 James
D280,280 S 8/1985 Pestone
D281,033 S 10/1985 Mohri
D287,764 S 1/1987 Topholm
D287,765 S 1/1987 Topholm
4,669,129 A 6/1987 Chance
D299,344 S 1/1989 Stevens
D318,670 S 7/1991 Taniguchi
5,036,681 A 8/1991 Schaerer
5,054,079 A 10/1991 Frielingsdorf et al.
D326,655 S 6/1992 Iribe
D344,524 S 2/1994 Taniguchi
5,345,509 A 9/1994 Hofer et al.
5,606,743 A 2/1997 Vogt et al.
5,654,530 A 8/1997 Sauer et al.
5,655,026 A 8/1997 Peters et al.
5,880,773 A 3/1999 Suzuki
5,887,720 A 3/1999 Lin
6,122,369 A 9/2000 Hwang et al.
6,122,388 A 9/2000 Feldman
D435,036 S 12/2000 Koss et al.
D436,960 S 1/2001 Budd et al.
D469,755 S 2/2003 Hlas et al.
D470,122 S 2/2003 Hlas et al.
D470,123 S 2/2003 Hlas et al.
D470,833 S 2/2003 Rath et al.
6,616,080 B1 9/2003 Edwards et al.
D481,709 S 11/2003 Solderits
6,690,807 B1 2/2004 Meyer
6,729,726 B2 5/2004 Miller et al.
6,868,164 B2 3/2005 Ito et al.
D505,132 S 5/2005 Linville et al.
D505,411 S 5/2005 Sakai
6,950,531 B2 9/2005 Rickards
6,975,644 B2 12/2005 Tordera et al.
6,978,034 B2 12/2005 Lazzeroni et al.
D514,551 S 2/2006 Lee et al.
D514,552 S 2/2006 Lee et al.
D519,108 S 4/2006 Yang
D521,493 S 5/2006 Wai
D521,927 S 5/2006 Franck et al.
D529,901 S 10/2006 Ohta
D531,169 S 10/2006 Tokioka et al.
7,182,820 B2 2/2007 Campbell et al.
D539,268 S 3/2007 Suzuki
D541,228 S 4/2007 Thursfield
D558,735 S 1/2008 Carr et al.
D560,311 S 1/2008 Li et al.
D569,841 S 5/2008 Chung et al.
D573,978 S 7/2008 Ledbetter et al.
D578,507 S 10/2008 Ando
D579,006 S 10/2008 Kim et al.
D582,389 S 12/2008 Bose et al.
7,461,936 B2 12/2008 Jannard
D584,284 S 1/2009 Carr et al.
D587,681 S 3/2009 Yanai
D591,264 S 4/2009 Hong et al.
7,551,748 B2 6/2009 Kamo et al.
D596,561 S 7/2009 Chon et al.
D599,785 S 9/2009 Matsuda et al.
D602,004 S 10/2009 Matsuoka
D602,064 S 10/2009 Mitsui et al.
D603,380 S 11/2009 Hutchieson
D604,501 S 11/2009 Lee
D606,971 S 12/2009 Christopher et al.
D612,595 S 3/2010 McCurdy
D614,166 S 4/2010 Brickstad
D614,168 S 4/2010 Rogers et al.
D618,211 S 6/2010 Oguro et al.
D620,256 S 7/2010 Fujimura et al.
D620,257 S 7/2010 Fujimura et al.
D620,482 S 7/2010 Chen
D621,389 S 8/2010 Nagayama et al.
D624,902 S 10/2010 Kolton
D627,764 S 11/2010 Tsai et al.
7,930,007 B2 4/2011 Andreasson
D637,585 S 5/2011 Nagayama et al.
D637,998 S 5/2011 Brunner et al.
D639,282 S 6/2011 Ohori et al.
D641,009 S 7/2011 Olodort et al.
D642,163 S 7/2011 Lee et al.
D643,405 S 8/2011 Rath
D643,414 S 8/2011 Lee et al.
D648,217 S 11/2011 Fahey et al.
D648,316 S 11/2011 Lee et al.
8,073,181 B2 12/2011 Bakalos et al.
D652,817 S 1/2012 Lee et al.
D654,056 S 2/2012 Hoggarth et al.
D654,866 S 2/2012 Rautiainen
D658,157 S 4/2012 McManigal
D659,991 S 5/2012 Long, Jr. et al.
D660,290 S 5/2012 Weedon
8,174,569 B2 5/2012 Tanijiri et al.
8,175,315 B2 5/2012 Tanaka et al.
D662,079 S 6/2012 Fahrendorff et al.
D663,715 S 7/2012 Glezerman et al.
8,218,808 B2 7/2012 Xu
8,229,154 B2 7/2012 Ito
8,249,286 B2 8/2012 Nault
D666,581 S 9/2012 Perez
8,265,325 B2 9/2012 Park
8,275,166 B2 9/2012 Wu
D674,373 S 1/2013 Combs et al.
8,345,913 B2 1/2013 Pang et al.
D678,242 S 3/2013 Von Euler
8,406,448 B2 3/2013 Lin et al.
D681,001 S 4/2013 Murchison et al.
8,442,257 B2 5/2013 Aase et al.
8,447,062 B2 5/2013 Lin
D685,750 S 7/2013 Nakagawa
D685,761 S 7/2013 Fletcher et al.
D685,764 S 7/2013 Coulter
D687,410 S 8/2013 Fletcher et al.
D692,408 S 10/2013 Dugger et al.
D692,409 S 10/2013 Takeno
D693,326 S 11/2013 Takeno
D697,962 S 1/2014 Olsson
D698,026 S 1/2014 Kuwata et al.
D698,750 S 2/2014 Yoon
D698,760 S 2/2014 Lee et al.
D698,762 S 2/2014 Zheng et al.
D699,226 S 2/2014 Yoon
D700,167 S 2/2014 Hardi

(56) References Cited

U.S. PATENT DOCUMENTS

| | | | | |
|---|---|---|---|---|
| 8,655,006 | B2 | 2/2014 | Aase et al. | |
| D703,634 | S | 4/2014 | Han | |
| 8,712,087 | B2 | 4/2014 | Ozawa | |
| D707,206 | S | 6/2014 | Akana et al. | |
| 8,755,555 | B2 | 6/2014 | Dougherty et al. | |
| 8,776,801 | B2 | 7/2014 | McIntosh | |
| D710,335 | S | 8/2014 | Yang | |
| D711,356 | S | 8/2014 | Yang | |
| D713,384 | S | 9/2014 | McNamara | |
| D715,777 | S | 10/2014 | Huang et al. | |
| D717,767 | S | 11/2014 | Mistry et al. | |
| D718,273 | S | 11/2014 | Harata et al. | |
| D718,286 | S | 11/2014 | Yang | |
| 8,891,798 | B1 | 11/2014 | Laffon de Mazieres et al. | |
| D718,745 | S | 12/2014 | Thompson et al. | |
| D719,131 | S | 12/2014 | Toelle et al. | |
| D719,132 | S | 12/2014 | Toelle et al. | |
| D719,551 | S | 12/2014 | Yang | |
| 8,908,899 | B1 | 12/2014 | Yang | |
| D727,279 | S | 4/2015 | Schaal et al. | |
| D727,871 | S | 4/2015 | Orbach | |
| 9,031,264 | B2 | 5/2015 | Yang | |
| D731,456 | S | 6/2015 | Dahlberg | |
| D731,793 | S | 6/2015 | Houghton et al. | |
| D732,511 | S | 6/2015 | Masters | |
| D736,185 | S | 8/2015 | Yaegashi et al. | |
| D736,251 | S | 8/2015 | Kim | |
| D737,251 | S | 8/2015 | Thompson et al. | |
| D740,653 | S | 10/2015 | Akana et al. | |
| D740,692 | S | 10/2015 | Christie et al. | |
| D742,070 | S | 10/2015 | Park | |
| D744,855 | S | 12/2015 | Akana et al. | |
| D746,792 | S | 1/2016 | Kim | |
| D774,760 | S | 12/2016 | Martinelli | |
| D776,083 | S | 1/2017 | Lee et al. | |
| D777,100 | S | 1/2017 | Price | |
| D777,710 | S | 1/2017 | Palmborg et al. | |
| D780,157 | S | 2/2017 | Uggla | |
| D781,269 | S | 3/2017 | Choe et al. | |
| D781,821 | S | 3/2017 | Petersen | |
| D785,594 | S | 5/2017 | Zaihui | |
| D796,475 | S | 9/2017 | Wang et al. | |
| 9,980,032 | B2 | 5/2018 | Yajima | |
| D822,636 | S | 7/2018 | Liu | |
| 2004/0113867 | A1 | 6/2004 | Tomine et al. | |
| 2004/0125977 | A1 | 7/2004 | Hong et al. | |
| 2004/0204177 | A1 | 10/2004 | Pon | |
| 2006/0008106 | A1 | 1/2006 | Harper | |
| 2006/0203998 | A1 | 9/2006 | Ben-Arie | |
| 2006/0281502 | A1 | 12/2006 | Chang et al. | |
| 2007/0064967 | A1 | 3/2007 | Feeley et al. | |
| 2007/0098201 | A1 | 5/2007 | Chen | |
| 2007/0201000 | A1 | 8/2007 | Jackson et al. | |
| 2007/0272686 | A1 | 11/2007 | Yu | |
| 2008/0101633 | A1 | 5/2008 | Ledbetter et al. | |
| 2008/0106693 | A1* | 5/2008 | Wang | G02C 11/10 351/158 |
| 2008/0123893 | A1* | 5/2008 | Lee | H04R 5/0335 381/376 |
| 2008/0159579 | A1 | 7/2008 | Park | |
| 2008/0317274 | A1 | 12/2008 | Kim | |
| 2009/0033574 | A1* | 2/2009 | Hung | H01Q 1/273 343/718 |
| 2009/0268935 | A1 | 10/2009 | Dillinger | |
| 2009/0304220 | A1 | 12/2009 | Fujikura et al. | |
| 2009/0323975 | A1 | 12/2009 | Groesch | |
| 2010/0045928 | A1 | 2/2010 | Levy | |
| 2010/0104126 | A1 | 4/2010 | Greene | |
| 2011/0012814 | A1 | 1/2011 | Tanaka | |
| 2011/0044487 | A1 | 2/2011 | Nault | |
| 2011/0216932 | A1 | 9/2011 | Wu | |
| 2011/0249856 | A1 | 10/2011 | Takei | |
| 2011/0255723 | A1 | 10/2011 | Obradovic et al. | |
| 2012/0020501 | A1* | 1/2012 | Lee | H04R 1/1091 381/151 |
| 2012/0087510 | A1* | 4/2012 | Sampimon | H04R 1/1083 381/74 |
| 2013/0077815 | A1 | 3/2013 | Stephenson | |
| 2013/0127980 | A1 | 5/2013 | Haddick et al. | |
| 2013/0272560 | A1* | 10/2013 | Dougherty | H04R 1/1066 381/378 |
| 2013/0315431 | A1 | 11/2013 | Grinker et al. | |
| 2014/0079275 | A1* | 3/2014 | Minarik | H04M 1/15 381/384 |
| 2014/0138150 | A1 | 5/2014 | Huang | |
| 2014/0140562 | A1* | 5/2014 | Huang | H04R 1/1033 381/378 |
| 2015/0023542 | A1 | 1/2015 | Shimizu | |
| 2016/0037248 | A1 | 2/2016 | Cheng | |
| 2016/0142808 | A1 | 5/2016 | Monahan et al. | |

FOREIGN PATENT DOCUMENTS

| | | | | |
|---|---|---|---|---|
| CN | 1893731 | A | 1/2007 | |
| CN | 102918443 | A | 2/2013 | |
| CN | 303113723 | | 2/2015 | |
| CN | 303691269 | S | 6/2016 | |
| CN | 303815854 | S | 8/2016 | |
| JP | 2005318112 | A | 11/2005 | |
| JP | 2007013873 | A | 1/2007 | |
| JP | 1509978 | S | 10/2017 | |
| JP | 1509979 | S | 10/2017 | |
| JP | 1516490 | S | 1/2018 | |
| JP | 1516491 | S | 1/2018 | |
| WO | 2011077160 | A1 | 6/2011 | |
| WO | WO 2011077160 | A1 * | 6/2011 | H04R 1/1016 |

OTHER PUBLICATIONS

International Search Report and Written Opinion for Application No. PCT/US2014/043804 dated Sep. 24, 2014.

Notification of the First Office Action for Chinese Patent Application No. 201480036676.4, dated Oct. 8, 2016.

Nokia Luna Bluetooth Headset With Wireless Charging BH-220p (Cyan). [retrieved on Jul. 24, 2015]. Retrieved from the Internet: <URL: <http://shopping.indiatimes.com/mobiles/bluetooth-headset/nokia-luna-bluetooth-headset-with-wireless-charging-bh-220p-cyan-/10011/p> B1420619 (undated) 1 page. Product publicly available prior to Jun. 25, 2015.

Earin, "The World's Smallest Wireless Earbuds", [retrieved on Jul. 24, 2015]. Retrieved from the Internet: <URL: <http://www.earin.com/>> (undated) 1 page. Product publicly available prior to Jun. 29, 2015.

Wanstonic Electronics Ltd. ER-III. High-Res Audio Earphone. p. 6. (undated).

Notice of Allowance for Japanese Design Patent Application No. 2017-027181, dated Aug. 21, 2018. 3 pages.

Notice of Allowance for Japanese Design Patent Application No. 2017-027182, dated Aug. 21, 2018. 3 pages.

Notice of Allowance for Japanese Design Patent Application No. 2017-027492, dated Aug. 17, 2018.

* cited by examiner

HEADPHONES WITH ADAPTABLE FIT

CROSS-REFERENCE TO RELATED APPLICATIONS

The present application is a continuation of U.S. patent application Ser. No. 14/939,503 filed Nov. 12, 2015 which is a continuation of U.S. patent application Ser. No. 14/143,687 filed Dec. 30, 2013 which claims the benefit of U.S. Provisional Patent Application No. 61/839,186 filed Jun. 25, 2013, the disclosure of which is hereby incorporated herein by reference.

BACKGROUND

Unless otherwise indicated herein, the materials described in this section are not prior art to the claims in this application and are not admitted to be prior art by inclusion in this section.

Headphones are a common type or wearable audio component and various forms of headphones are available and have been developed to offer varying degrees of portability and include different ways of being worn by the users thereof. In general, headphones include one or more speakers or other audio sources positioned in one or more housings. Typically, two housings are employed that can be worn in proximity to each of the respective ears of the user. In one example, some types of headphones include two such housings configured with cups or pads that fit over or on the user's ears and are secured together and against the ears or head of the user by a resiliently-deformable band.

Other types of headphones that can be referred to as earbud or in-ear headphones, include generally smaller audio components secured in housings that can be made to be small enough to engage independently with the respective ears of the user. Such headphones can be structured to engage with the ear in a number of different ways, examples of which include engaging with particular features of the outer ear and/or extension of a portion thereof into the opening or transition area between the outer ear and the ear canal. Because of the wide variation in the particular structure and size of ears among the general population, the ability to fit a wide range of people with a single earbud or in-ear headphone structure can present challenges. Further, size considerations, including for example, the size needed to achieve the desired fit and positioning with the ear and/or weight considerations can result in balancing between acceptable fit and a desired level of sound quality. In some examples, fit can be improved using smaller structures, but such smaller structures can compromise sound quality.

Computing devices such as personal computers, laptop computers, tablet computers, cellular phones, and countless types of Internet-capable devices are increasingly prevalent in numerous aspects of modern life, and are becoming a significant type of device with which headphones are used. Over time, the manner in which these devices are providing information to users is becoming more intelligent, more efficient, more intuitive, and/or less obtrusive. The trend toward miniaturization of computing hardware, peripherals, as well as of sensors, detectors, and image and audio processors, among other technologies, has helped open up a field sometimes referred to as "wearable computing." In the area of image and visual processing and production, in particular, it has become possible to consider wearable displays that place a graphic display close enough to a wearer's (or user's) eye(s) such that the displayed image appears as a normal-sized image, such as might be displayed on a traditional image display device. The relevant technology may be referred to as "near-eye displays."

Wearable computing devices with near-eye displays may also be referred to as "head-mountable displays", "head-mounted displays," "head-mounted devices," or "head-mountable devices." A head-mountable device ("HMD") places a graphic display or displays close to one or both eyes of a wearer. To generate the images on a display, a computer processing system may be used. Such displays may occupy a wearer's entire field of view, or only occupy part of wearer's field of view. Further, head-mounted displays may vary in size, taking a smaller form such as a glasses-style display or a larger form such as a helmet, for example.

Both head-mounted and heads-up displays can be connected to a video source that receives a video signal that the device can read and convert into the image that they present to the user. The video source can be received from a portable device such as a video player, a portable media player or computers. Some such display devices are also configured to receive sound signals, which can be delivered to the user typically through various types of headphones. However, the form-factors employed by such displays can present challenges when attempted to be used with existing headphones or similar devices.

BRIEF SUMMARY

The present disclosure related to a headphone assembly or other wearable audio component that can be in the general form of an earbud or in-ear headphone assembly with one or more speaker housings or earpieces. The headphone assembly, through various structures thereof, can be configured to use a portion of the signal cable or cables associated with the earpieces to engage a portion of the user's ear to help retain the earpiece in a desired location with respect to the ear. The headphone assembly can also include internal structures configured to provide improvements to the audio produced thereby. Still further, the headphone assembly can be adapted to be used with a head-wearable display device.

An aspect of the present disclosure, accordingly, relates to a wearable audio component including a first cable and an audio source in electrical communication with the first cable. The component further includes a housing defining an interior and an exterior, the audio source being contained within the interior of the housing. The exterior includes an ear engaging surface, an outer surface, and a peripheral surface extending between the ear engaging surface and the outer surface. The peripheral surface includes a channel open along a length thereof to surrounding portions of the peripheral surface and having a depth so as to extend partially between the front and outer surfaces. A portion of the channel is covered by a bridge member that defines an aperture between and open to adjacent portions of the channel. The cable is connected with the housing at a first location disposed within the channel remote from the bridge member and is captured in so as to extend through the aperture in a slidable engagement therewith. A first portion of the cable extends between the first location and the aperture such that an amount of the fixed overall length of the cable that is within the first portion can be varied by the slidable engagement of the cable with the opening.

The amount of the fixed overall length of the cable that is within the first portion can be variable by extension and contraction of a loop of the cable that extends radially outwardly from a portion of the channel between the first location and the aperture. Such extension and contraction can be implemented, for example, by a user.

The housing can be receivable by portion of outer ear of wearer with a portion of peripheral surface contacting the tragus of the ear and a portion of the ear engaging surface overlying the external auditory meatus during wear. The housing can further define an audio port open to the interior of the housing in communication with the audio source and at least within the portion of the surface that overlies the external auditory meatus, and the loop can be configured to be extendable so as to be positionable against a portion of the cavum of the ear.

Another aspect of the present disclosure relates to a wearable audio component including a housing defining an interior and an exterior. The exterior is at least partially defined by an ear engaging wall with an outlet port therein and an outer wall opposite the ear engaging wall. The interior includes an interior wall at least partially separating a first interior compartment from the second interior compartment, the first interior compartment being adjacent the ear engaging wall and the second interior compartment being adjacent the outer wall. A reflex tube having a generally spiral shape is defined within the interior wall and has a first end open to the first interior compartment and a second end open to the second interior compartment. The component further includes an audio source within the first interior compartment. The audio source has a front side facing the outlet port of the ear engaging wall and a back side thereof facing the interior wall. The spiral shape of the reflex tube can lie along and can be radially disposed on a plane parallel to the outer wall.

Another aspect of the present disclosure relates to a system. The system includes a head-wearable device having a center support extending in generally lateral directions, a first side arm extending from a first end of the center frame support, and a second side arm extending from a second end of the center support. An extension arm configured to present information to a user via a display extends at least partially along the first side arm on a first side of the center support and further extends from the first side arm to a display end that supports the display in a position on a second side of the center support. The extension arm includes a connection port on a surface thereof. The system also includes a headphone assembly including a connection structure configured to engage with the connection port of the head-wearable device and a first headphone unit connected with the connection structure by a first cable. The first cable has a first length of between about 50 mm and 100 mm such that the first headphone unit is positionable in an ear adjacent the extension arm while the head-wearable device is being worn by a user.

The headphone assembly can further include a second headphone unit connected with the connection structure by a second cable. In such an example, second cable can be of a second length that is greater than the first length and such that the second headphone unit is positionable in an ear opposite the extension arm while the head-wearable device is being worn by a user.

DETAILED DESCRIPTION

Figure 1:
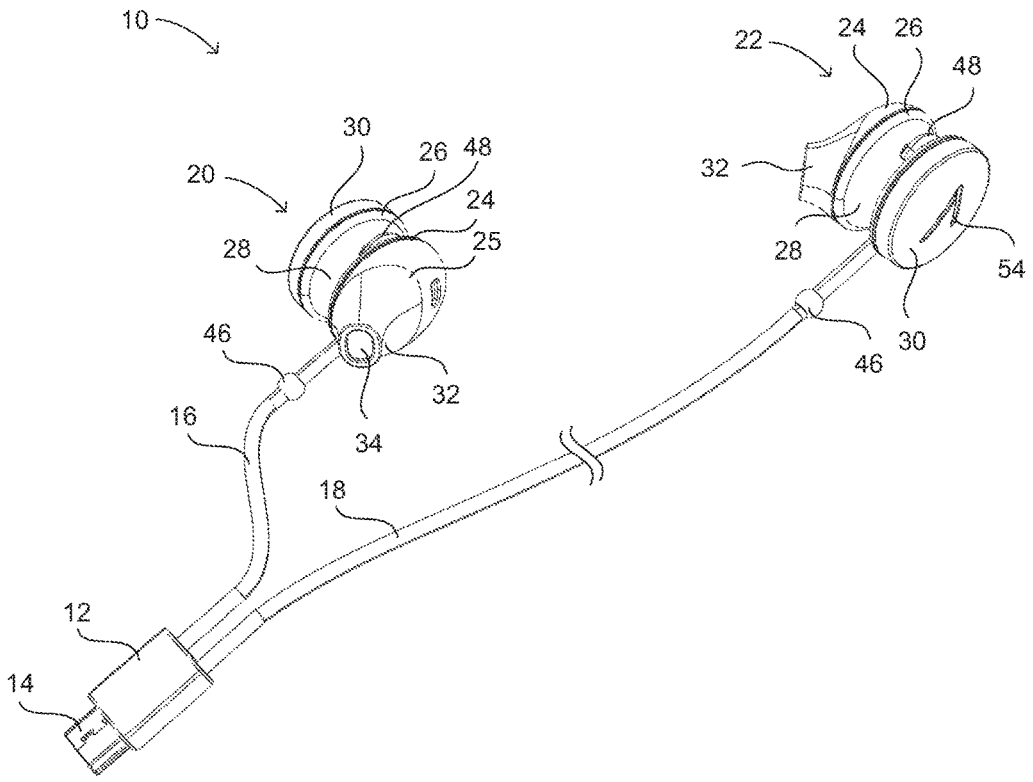
FIG. 1 shows a headphone assembly according to an aspect of the present disclosure.

Turning now to the figures, where similar reference numerals are used to indicate similar features, FIG. 1 shows an example of a headphone assembly 10 according to an aspect of the present disclosure. Headphone assembly 10 includes a plug assembly 12 with a connection component 14 extending therefrom. The connection component 14 is shown in the example of FIG. 1 as a USB-mini male connection structure that is configured to mate and connect with a corresponding USB-mini female connection structure in an external device (an example of which is described below). Other structures are possible for the connection component 14 that can be configured to match with other receiving structures in a variety of devices. In general, the connection component 14 is configured to electronically connect with a mating structure in a device that has an audio signal source therein. The connection component 14 and the mating structure in the associated device are connectable together such that the headphone assembly 10 can receive the audio signal from the device by the connection achieved by the connection component 14. Other examples of structures that can be used for a connection component include, but are not limited to: a 3.5 mm or ¼" stereo audio jack, a USB A or B structure, or the like.

Headphone assembly 10 further includes first and second cables 16 and 18 that attach the plug housing 12 with respective first and second headphone units 20 and 22. It is noted that cable 16 is shown having a particular length that can be exemplary and can be implemented in specifically-configured examples of headphone assembly 10, as will be discussed herein. Other lengths for both cables 16 and 18 are possible and can be selected depending on preference or the intended use of headphone assembly 10. In the example shown in FIG. 1, first headphone unit 20 is generally configured as a right headphone and second headphone unit 22 is generally configured as a left headphone. That is, the respective headphones 20 and 22 are generally mirror images of each other, with headphone 20 being configured for a desired fit in the right ear of a wearer and, when assembly 10 receives a stereo audio signal, configured to receive the right channel signal. Similarly, headphone 22 can be configured for a desired fit in the left ear of the wearer and, when assembly 10 receives a stereo audio signal, configured to receive the left channel signal. The desired fit between the respective ears of the wearer can include the particular shape of the headphone, including the positioning and orientation of various features thereof, as will be discussed in further detail below. The desired fit can also take into account the connection location of the respective headphones 20 and 22 with cables 16 and 18 and the direction in which they extend therefrom, as will also be discussed below, to achieve a desired level of comfort and positioning of the cables 16 and 18 when the headphones 20 and 22 are being worn.

As headphones 20 and 22 are generally mirror images of each other, the particular features thereof are discussed with reference to the same reference numerals and are shown in various examples herein in the context of the right headphone 20. It is to be known that the left headphone 22 can include similar or identical structures as discussed with respect to the right headphone 20, but in a mirror image thereof, where necessary. In particular, headphone 20 includes an earpiece 24 configured with an outside surface 25 that is configured to generally match the rough anatomy and geometry of the ear of a wide variety of potential wearers and to be placed in contact therewith. Such a configuration can include the somewhat rounded shape shown in the example of FIG. 1 that transitions into a projection 32 that is directed in what is intended to be a forward-oriented position such that it is in the general direction of the user's eyes when being worn. The projection 32 is dimensioned to extend partially into the external auditory meatus of the ear and to contact the inside surface thereof at least partially around the surface 25 in the area of projection 32. Such a configuration is what can generally be referred to as an in-ear or a partial in-ear configuration. Other configurations of surface 25 are possible, such as those that define a surface 25 that does not extend into, but rather simply overlies, the external auditory meatus.

To further enhance the fit between the earpiece 24 and the ear of a wearer, earpiece 24 can be made of a resiliently compliant material such that earpiece 24 can flex, compress, and generally adapt to the variations in the shapes of potential wearers' ears. In an example, earpiece can be a compliant material such as a rubber or foam, or a soft-touch material such as TPE or various forms of injection-moldable silicon compounds or composites. Earpiece 24 can also be of a coated or compression-molded memory-foam material or can include a gel-filled membrane therein. Other structures or materials having similar characteristics are also possible for earpiece 24.

Earpiece 24 can be affixed with and generally extend from a body 26 that defines an outer periphery of the earpiece that extends laterally from the outside edges of surface 25 of earpiece 24. The body 26 can be based on a generally cylindrical structure that can extend from a generally circular outside edge defined by surface 25 at the plane of intersection therewith. Body 26 can be configured to retain therein various internal components related in generating sound from the audio signal transmitted by cable 16. Such components can include a speaker unit or a diaphragm with a partially magnetized structure, along with a driver for causing movement or vibration of the diaphragm to generate sound waves. Such components can also include internal circuitry specially adapted for carrying out tuning, equalization, or other filtering or crossover functionality, as desired to achieve a desired sound from the headphone 20. The filtering and equalization can include adjustment for the size and material of the speaker structure, as well as the geometry of the interior of body 26 and/or earpiece 24. Body 26 can include an interior cavity to receive such components and configured such that the various components can attach therein.

Body 26 can also be configured such that the interior thereof is at least partially open to an interior of the earpiece and such that the speaker, or other sound-generating component, is directed toward the interior of earpiece 24 and is further directed toward projection 32. Accordingly, earpiece 24 can include an output port such as the output port 34 on the end of projection 32 shown in FIG. 1. Such a configuration allows the sound generated within headphone 20 to be directed into the ear in which headphone 20 is being worn.

Figure 2:
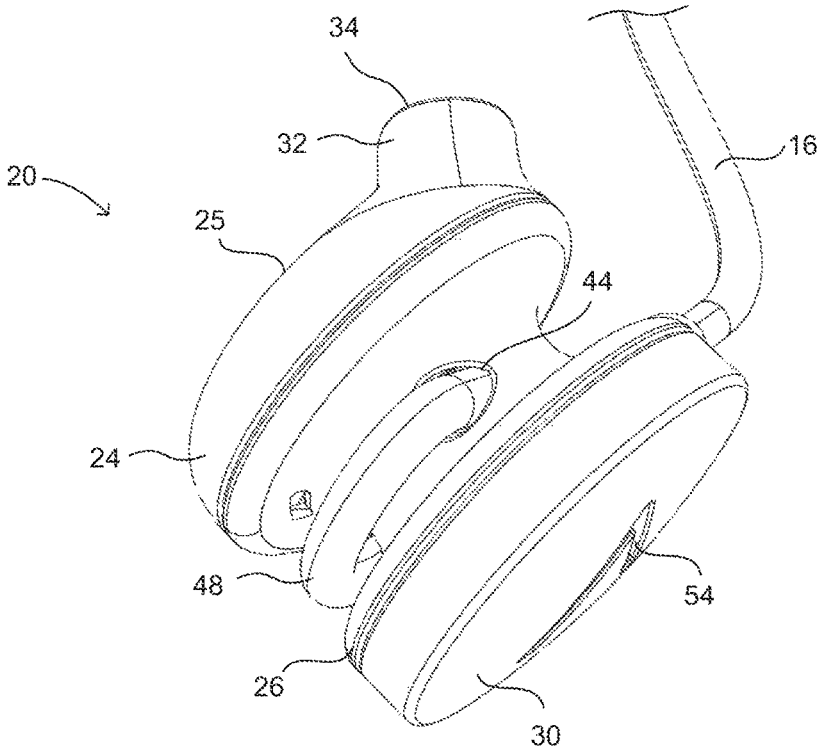
FIG. 2 shows a detail view of a portion of the headphone assembly of FIG. 1.
Figure 3:
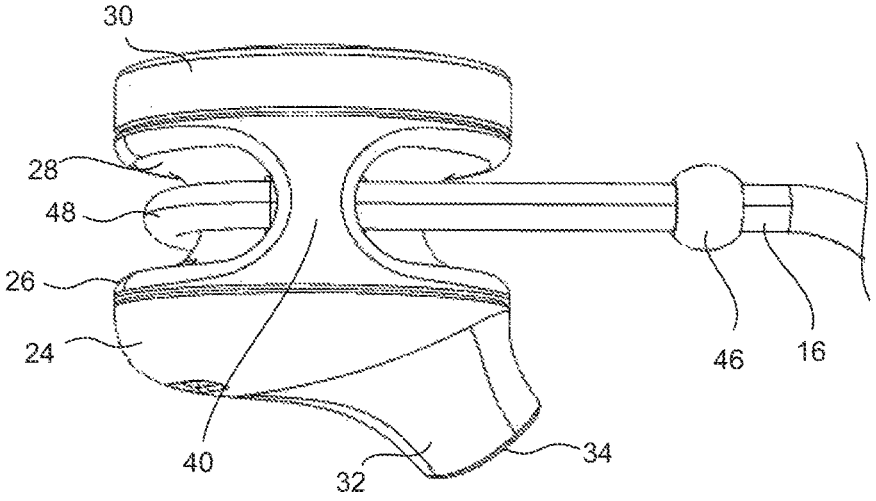
FIG. 3 shows another detail view of a portion of the headphone assembly of FIG. 1.

As shown in greater detail in FIGS. 2 and 3, body 26 can be configured to define a channel 28 that extends at least part way around the periphery thereof. Accordingly, such a channel 28 can interrupt the generally cylindrically configured shape of body 26. Channel 28 can have a generally U-shaped configuration and can smoothly transition to the outer periphery of body 26, as shown in the example of FIG. 2. Channel 28 can have a depth extending in a radially-inward direction with respect to body 26 and a length extending circumferentially around at least part of the body 26. The depth and width (in a direction transverse to the depth) can be at least as great as a diameter of cable 16 so that cable 16 can fit within at least a portion of channel 28, as shown in FIG. 2. Further, channel 28 can be at least 125% as large as the diameter of cable 16 in both width and depth so that channel 28 can fit therein and be removed therefrom, as will be discussed further below, without interference therebetween. Cable 16 can be configured to connect with and at least partially enter into body 26 at a location within channel 28. Further, cable 16 can be configured to connect with body 26 at an angle toward the interior of channel 28 so that the portion of cable 16 immediately adjacent body 26 extends generally within channel 28.

Figure 4:
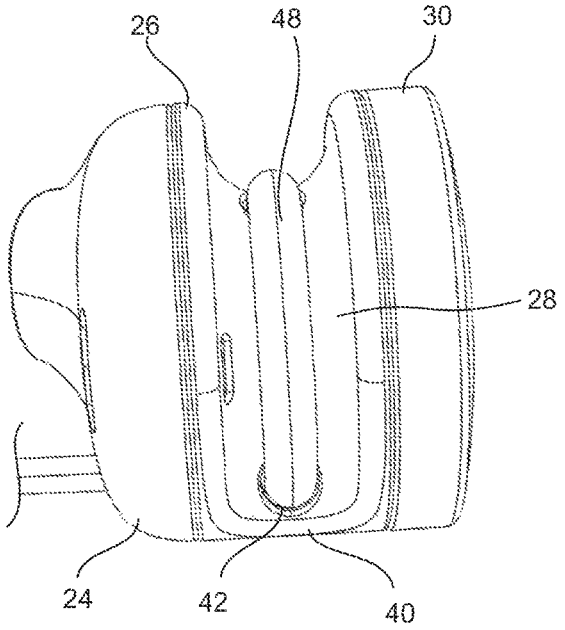
FIG. 4 shows another detail view of a portion of the headphone assembly of FIG. 1.

Body 26 can further define a bridge 40 extending over a portion of channel 38. Cable 16 can then extend within channel 28 beneath bridge 40 so that it is partially captured within and passes through an aperture 42 defined between a portion of bridge 40 that faces channel and the corresponding portion of channel 28 that underlies bridge 40, as shown in FIG. 3. Bridge 40 can be positioned at a location along channel 28 that is remote from the location 44 at which cable 16 attaches with body 26. In an example, bridge 40 can be disposed from location 44 through an angle of between about 170 degrees and 190 degrees around the circumference of body 26. Accordingly, a section 48 of cable 16 extends between location 44 and bridge 40. Aperture 42 can be configured to be smaller than adjacent portions of channel 28, as shown in FIG. 4 such that cable 16 is more closely received therein. In a configuration, aperture 42 can further be configured to maintain an interference fit with the portion of cable 16 that passes therethrough by having at least a portion thereof that is undersized in at least one dimension relative to cable 16.

Figure 5:
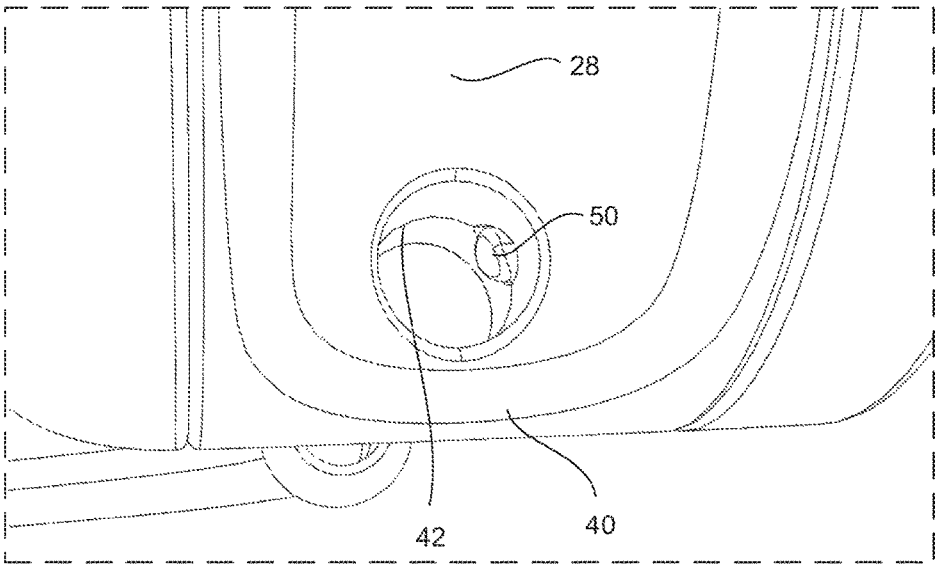
FIG. 5 shows another detail view of a portion of the headphone assembly of FIG. 1, with certain structures removed therefrom for clarity.

As shown in FIG. 5, a projection 50 can extend into a portion of aperture 42 to achieve the discussed interference fit with cable 16. Such an arrangement can be useful, for example, when body 26 is made from a generally rigid material such as polycarbonate plastic ("PC"), PC-ABS, or the like. As a reliable interference fit within generally acceptable tolerances is difficult to achieve with rigid materials, the body 26 and, accordingly, aperture 42 can be of a rigid material that is close in size to the diameter of cable 16 or is slightly oversized with respect thereto. Projection 50 can extend through a hole in body 26 within aperture 42 so as to extend partially into aperture 42 or can be otherwise attached therein. Further, projection can be positioned on a flexible mount to attach within body 26 or can be made from a compliant material, such as TPE or the like. Projection 50 can be configured to extend into aperture 42 at least by a distance by which aperture 42 is oversized with respect to cable 16 (or at a distance that is at least as large as the tolerance of aperture 42) so that the distance between projection 50 and a portion of aperture 42 that is directly opposite projection 50 is less than the diameter of cable 16. The particular extension distance of projection 50 can be adjusted based on the materials used and the desired level of the interference fit desired. Further, cable 16 can itself be configured to contribute to the interference fit, such as by including a texture on the outer surface thereof. In an example, cable 16 can have an outer jacket made of a fabric, such as woven nylon or other fiber or fiber blend. In another example, cable 16 can be of a molded polymer, such as TPE or the like, with a ribbed or knurled texture applied thereto.

Figure 6:
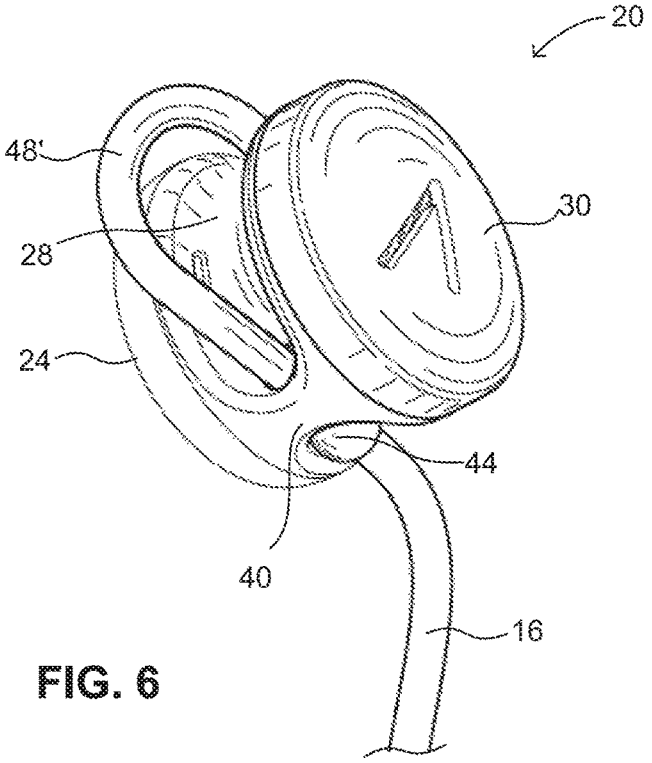
FIG. 6 shows a detail view of a portion of the headphone assembly of FIG. 1 in a further configuration thereof.

The above-described interference fit between cable 16 and aperture 42 can help retain the section 48 of cable 16 to be retained within channel 28, if so desired by a wearer of headphone 20. Further, because section 48 is slidably received through aperture 42, cable 16 can slide relative thereto, allowing section 48 to be extended from out of channel 28 in a loop 48' thereof, as shown in FIG. 6. The interference fit between cable 16 and aperture 42 can provide a friction force therebetween sufficient to temporarily maintain the presence of loop 48' under application of forces below a predetermined general threshold level. This can allow the wearer of headphone 20 to selectively adjust the size of loop 48' by pulling on cable 16 on either side of bridge 40 to either pull more cable 16 into loop 48' or to pull portions of cable 16 out of loop 48', which can be continued until loop 48' is fully pulled into channel in the form of cable 16 length 48 in FIG. 4. A bead 46 (FIG. 3) can be attached along a location of cable 16 to prevent more than a predetermined length of cable 16 from being drawn into loop 48'.

Figure 7:
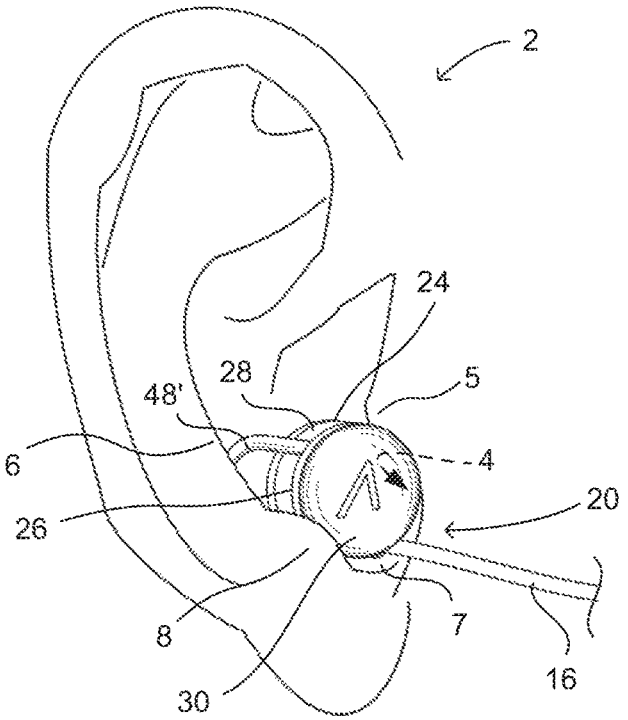
FIG. 7 shows a view of a portion of the headphone assembly of FIG. 1 in a position within an ear of a wearer.

In an example, body can be configured such that areas outside of channel 28 have an external diameter of between about 12 and 25 mm, and in one example between about 15 and 16 mm, channel 28 can have a depth of between approximately 1 mm and 5 mm and in an example about 3 mm such that it has an diameter at the innermost point thereof of between 12 and 13 mm (+/−10%), for example. Further, cable 16 can have a diameter of between about 1.5 mm and 2 mm, for example (+/−10%). In such an example, bead 46 can be positioned along cable 16 at a distance of approximately 30 mm to 35 mm from location 44. In such an example, loop 48' can be extended from out of channel 28 such that it has an internal dimension 49 between an apex thereof an opposite surface of body 26 such that dimension 49 is between about 12 and 15 mm and in an example about 14 mm The selective expansion of length 48 of cable 16 into a loop 48' of varying sizes (and the corresponding contraction of a loop 48' to a retracted length 48 of cable 16) can provide users of headphone 20 with a selectively adjustable fit of headphone 20 within the wearer's ear. As shown in FIG. 7, headphone 20 can be received within the ear 2 in the orientation thereof discussed above, such as with projection 32 of earpiece 24 partially inside and forward-facing within the external auditory meatus 4 of the ear and with earpiece 24 nested between the tragus 5 and the antitragus 8. In such a configuration, the sizing and positioning of headphone 20, along with the possible use of compliant materials for earpiece 24 can generally maintain headphone 20 in the desired positioning within the ear 2. However, some users may desire additional security in the fit and positioning of headphone 20, as can be dictated by personal preference or the particular anatomy of the wearer's ear. Accordingly, loop 48' can be extended and sized, as described above, to provide a structure to engage with additional portions of the ear 2 to provide additional security of fit and/or improved retention of headphone 20 within ear 2.

As shown, with headphone 20 positioned in the ear 2, as discussed above, cable 16 can extend from location 44, which can be positioned such that loop 48' extends rearward, or opposite the direction of tragus 5. Loop 48' can then bend downward and return to a forward-extending direction to pass through aperture 42 and to extend through the notch 7 between the tragus 5 and antitragus 8. Such positioning of cable 16 as it exits aperture 42 can provide a comfortable fit with minimal interference with the structures of ear 2 (and can be the same when loop 48' is retracted to section 48 of cable 16 within channel 28). Loop 48' in this manner can be configured to extend toward and contact the ear 2 along and within the cavum 6 of the ear.

The flexibility of cable 16, including within loop 48' can provide a compliant, spring-like fit within the cavum 6 such that cable flexes to follow a portion of the shape of the wearer's cavum 6. This force can urge earpiece 24 in a forward direction, which can help maintain projection 32 within the external auditory meatus 4, which can further help maintain headphone 20 within the ear 2, as the tragus 5 can overlie the projection 32 in such a manner By taking up additional space within the ear 2 and providing additional points of contact and a spring force to help maintain such contact, the fit and retention of headphone 20 within ear 2 can be augmented.

The above-described adjustment of the size of loop 48' can be done to both bring loop 48' into contact with the cavum 6, depending on the anatomy of the wearer's ear. Such adjustment can further be done to allow the user to adjust the amount of pressure that the cable 16 within loop 48' exerts on the cavum 6. Cable 16 can be configured to be of the same construction along the entire length thereof (such as within the portions thereof in comprising loop 48' and portions of the opposite side of bead 46 thereof). The overall cable characteristics, therefore, can be selected to give loop 48' a desired spring force, and to allow cable 16 to be wound for storage of headphone assembly 10 and to provide a comfortable and aesthetically-pleasing drape or the like.

As described herein, the channel 28 in the body 26 of headphone 20 is configured such that various portions of cable 16 can extend therein in positions that are recessed with respect to body 26. Such portions can include the portion of cable 16 adjacent location 44 and both exiting and entering aperture 42 beneath bridge portion 40. Additionally, channel 28 can receive all of the section 48 between location 44 and bridge 40, when positioned therein. This can be done when the anatomy of a user's ear 2 is such that loop 48' is not needed to achieve a proper fit, for example, or in instances where a loop 48' is otherwise not desired.

Accordingly, channel 28 can be configured to extend at least from adjacent location 44 with enough clearance for cable 16 to extend from housing 26 to the area at bridge 40 where it is partially interrupted by aperture 42. Channel 28 can further extend on the opposite side of bridge 40 to allow cable 16 to exit aperture 42 without interference and in the positioning describe above. As in the example shown, however, it may be desired to configure channel 28 to extend generally completely around the periphery of body 26 (except where interrupted by bridge 40). This can be done for aesthetic purposes, such as for visual continuity. Further channel 28 can be positioned along a portion thereof such that the tragus 5 can be partially received therein. This can further improve the fit and retention of headphone 20 and/or can prevent body 26 from uncomfortably interfering with the tragus 5.

Figure 8:
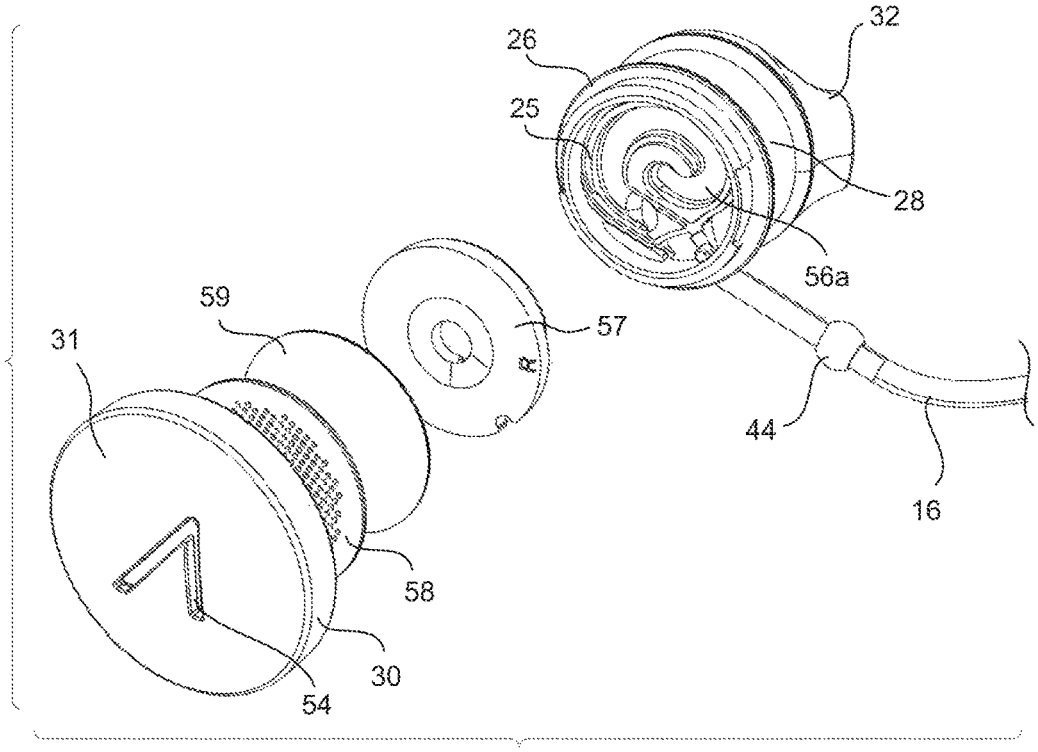
FIG. 8 is an exploded detail view showing some example internal components of the headphone assembly of FIG. 1.

A cap 30 can be attached with body 26 opposite earpiece 24. Cap 30 can define an outer surface 31 opposite earpiece 24 that can generally follow the circular profile of body 26. As shown in FIG. 8, cap 30 can be removably attached with body (such as through a ¼ turn bayonet attachment or the like). Such a removable attachment can allow for cap 30 to be removed for access to the internal structure of headphone 20 and/or to allow the user to replace cap 30 with another cap 30 having a different visual appearance. In an example, a number of different caps 30 can be provided or otherwise available to a wearer in a commercial setting. Such caps 30 can be of different colors, materials, or surface textures. Still further, such caps can have different logos or other graphic features thereon, which in some settings, can be customizable.

As further shown in FIG. 8, body 26 can include an interior wall 55 therein that can be positioned between a portion of the interior on the side of earpiece 24 and another portion of the interior of body 26 on the side of cap 52. The portion of interior of body 26 on the side of cap 30 can include various acoustic structures of headphone 20. As shown, an insert 57 can be provided within body 26 and inside of cap 30 so as to contact a portion of wall 55. Insert 57 and wall 55 can be configured to define a reflex tube 56 between portions thereof.

Figure 9:
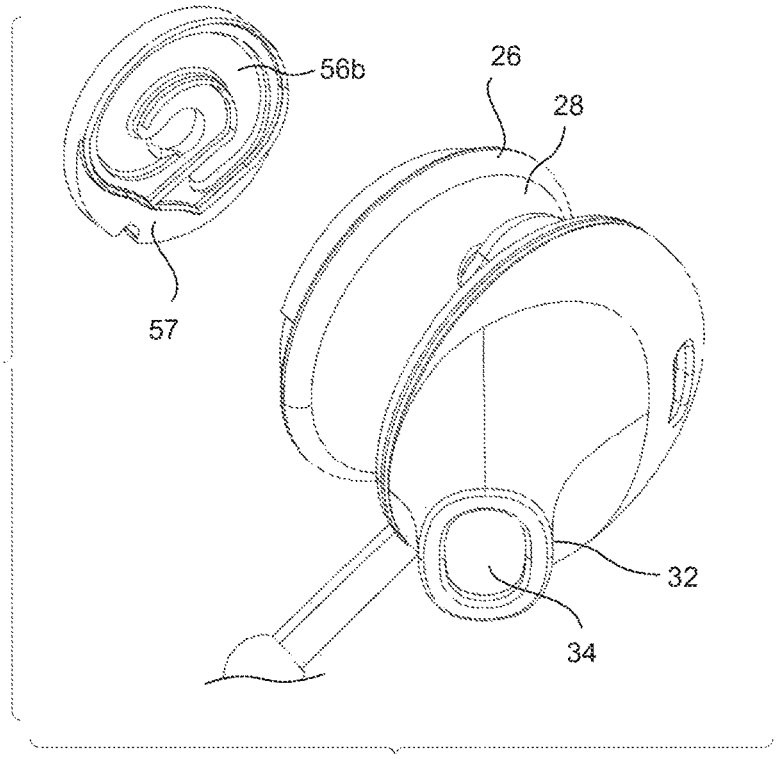
FIG. 9 is another exploded detail view showing some example internal components of the headphone assembly of FIG. 1.

As shown in FIG. 8, a portion 56*a* of reflex tube is defined as a spiral channel in wall 25. As further shown in FIG. 9, the other portion of reflex tube 56 is defined as a mating spiral channel in insert 57. When insert 57 is positioned against wall 25, portion 56*a* and portion 56*b* match to define a spiral, tubular structure for reflex tube 56. Such a structure can be configured to extend through a distance of at least 20 mm, and in an example approximately 25 mm, and can have a diameter of between 1 mm and 3 mm, for example (+/−10%). Reflex tube 56, configured as shown can provide a resonance chamber for lower, or bass, frequencies produced by the sound source within body 26, which can improve the responsiveness of headphones to low frequencies, thereby enhancing the sound quality of headphones. By configuring reflex tube 56 as a outwardly-radiating spiral that lies along a single plane (defined by the intersection between wall 55 and the mating face of insert 57, for example), a desirably-configured resonance chamber can be provided within a compact form suitable for headphones 20 as shown herein.

Cap 30 can further include a vent port 54 therein to provide for movement of air in and out of the interior space of body 26 on the cap side of wall 55. The presence of vent port 54 can provide for movement of air in and out of housing 26 and, in particular ingress and egress of air through reflex tube 56. This can prevent pressure from within housing 26 from preventing free movement of air within reflex tube 56. As in the examples shown in the Figures, vent port 54 can be configured as a stylized logo to provide source-identifying characteristics. This allows for both product branding and for device functionality, as described above, without the addition of further features, as products such as headphones often already have some branding identification in such a location. The stylized vent port 54 can extend through cap 30 and can have an area tuned to provide the desired pressure gradient therethrough. In an example vent port 54 can have an area of between about 0.08 $cm^2$ and 0.1 $cm^2$, and in one example about 0.09 $cm^2$. The desired area can also take into account additional features or structures underlying cap 30. In the example shown in FIG. 8, a mesh disk 58 and a foam insert 59 underlie cap and prevent dust or other debris from entering housing 26 through vent port 54. Such features may slow movement of air through vent port 54, and accordingly, may require a larger overall area for vent port 54.

Figure 10:
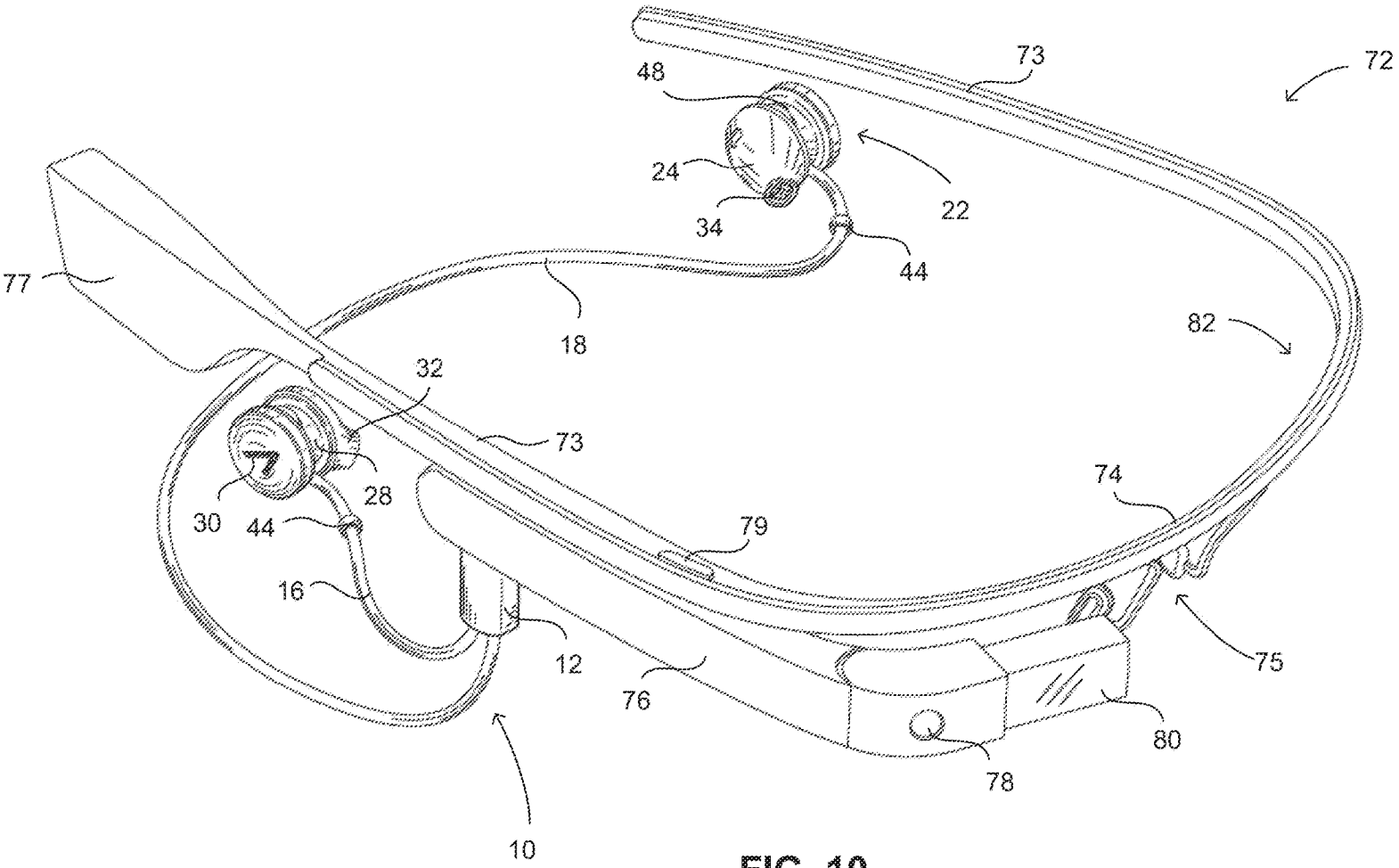
FIG. 10 shows an example of the headphone assembly of FIG. 1 in use with an example head-mountable display device.

Headphone assembly 10 can, in an example, be specially adapted for use thereof with certain head mountable devices ("HMDs", or "HMD" in the singular). An example of one such HMD 72 is shown in FIG. 10, and is a computing device configured to be wearable on the head of the user. As shown, the HMD 72 may include a band 82 that defines side-arms 73, a center frame support 74, and a nosepiece 75. In the example shown in FIG. 10, the center frame support 174 connects between the side-arms 173. In other examples, HMD 72 can include lenses in a structure similar to that shown in co-pending, commonly assigned U.S. patent application Ser. No. 13/435,944, the entire disclosure of which is incorporated by reference herein. Such lenses can be, for example, corrective lenses that can be transparent, can be tinted, or can otherwise include sun protection such that HMD 72 can provide corrective lenses and selective sun protection.

In such an HMD 72, an end of one of the side arms 73 can be enlarged in the form of an auxiliary housing 77 that can house circuitry and/or a power supply (e.g., removable or rechargeable battery) for HMD 72. In an example, auxiliary housing 77 can be configured and positioned to provide a balancing weight to that of component housing 76. The components within auxiliary housing 77, such as a battery or various control circuitry can be arranged to contribute to a desired weight distribution for HMD 72.

Side arms 73 can be configured to contact the head of the user along respective temples or in the area of respective ears of the user. Further, band 82 can be configured to resiliently deform through a sufficient range and under an appropriate amount of force to provide a secure fit on user's heads of various sizes. To accomplish this band 82 can be structured to elastically deform (or resiliently deform) such that the distance between the ends of side arms 73 increases under force. In an example, band 82 can be configured such that it conforms to fit on a user's head by flexing laterally of center frame support 74, and further such that center frame support 74 does not substantially deform during such flexing.

In general, the nature of the construction and materials of band 82 can be such that the band 82 can maintain the desired shape thereof while allowing flexibility so that band 82 can expand to fit on a user's head while applying a comfortable pressure thereto to help retain band 82 on the user's head. Band 82 can, accordingly, be elastically deformable up to a sufficiently high threshold that the shape of band 82 will not be permanently deformed simply by being worn by a user with a large head.

As discussed above, center frame support 74 includes nosepiece 75 configured to rest on the nose of a wearer with the center frame support 74 providing a central support for side arms 73, which can extend unitarily therefrom, or can at least appear to extend unitarily therefrom, with an area of transition between the center frame support 74 and the side arms 73 including a bend or curve therebetween.

The arrangement and configuration of nosepiece 75 is such that HMD 72 can be worn on a user's head with nosepiece 75 resting on the user's nose with side arms 73 extending over respective temples of the user and over adjacent ears. The HMD 72 can be configured, such as by adjustment of nosepiece 75 or display 80 to ensure the display 80 is appropriately positioned in view of one of the user's eyes. As discussed above, in one position, HMD 72 can be positioned on the user's head with nosepiece 75 adjusted to position display 80 in a location within the user's field of view, but such that the user must direct her eyes upward to fully view the image on the display.

The HMD 72 may include a component housing 76, which may include an on-board computing system (not shown), an image capture device 78, and a button 79 for operating the image capture device 78 (and/or usable for other purposes). Component housing 76 may also include other electrical components and/or may be electrically connected to electrical components at other locations within or on the HMD. Additionally, component housing 76 can include additional input structures, such as additional buttons (not shown) that can provide additional functionality for HMD 72, including implementing a lock or sleep feature or allowing a user to toggle the power for HMD 72 between on and off states. Component housing 76 can also include one or more connection ports or outlets to allow external components to connect with HMD 72. In an example, an audio jack and/or a USB port (A, B, or mini sized in various examples). That can provide power, data, and/or audio connections for appropriately-configured external devices to connect with HMD 72 in various ways to add functionality or the like to HMD 72

The HMD 72 may include a single display 80, which may be coupled to one of the side-arms 73 via the component housing 76. In an example embodiment, the display 80 may be a see-through display, which is made of glass and/or another transparent or translucent material, such that the wearer can see their environment through the display 80. Further, the component housing 76 may include the light sources (not shown) for the display 80 and/or optical elements (not shown) to direct light from the light sources to the display 80. As such, display 80 may include optical features that direct light that is generated by such light sources towards the wearer's eye, when HMD 72 is being worn.

As discussed above, HMD 72 can include an outlet or other connection port on, for example, a surface of component housing 76. Such a connection port can be of the same type as or can have a mating configuration to the connection component 14 of headphone assembly 10. The connection port of HMD 72 can be included on, for example, the lower surface of component housing 76, which is positionable along, for example, the right side of the user's head. The port in HMD 72 can be configured to transmit an audio signal therethrough to only a compatible device, and headphone assembly 10 can be configured as such a compatible device. Accordingly, in an example of headphone assembly 10 that is intended to be used with HMD 72 or a similar device, the cables 16 and 18 can be specifically adapted to take into account the location of connection between headphone assembly 10 (i.e., through connection component 14 of plug housing 12) to HMD, which is made along the lower surface of component housing 76. In such a configuration, cable 16 that connects between plug housing 12 and right headphone 20 can be of a relatively short length because the distance between plug housing 12 when attached with component housing 76 is also relatively short (i.e. less than 100 mm). In an example cable 16 can be between about 70 mm and 100 mm Such a relatively short configuration can minimize excess cable when headphone 20 is worn in the ear adjacent component housing 76 (in the general position of headphone 20 shown in FIG. 10.

Figure 11:
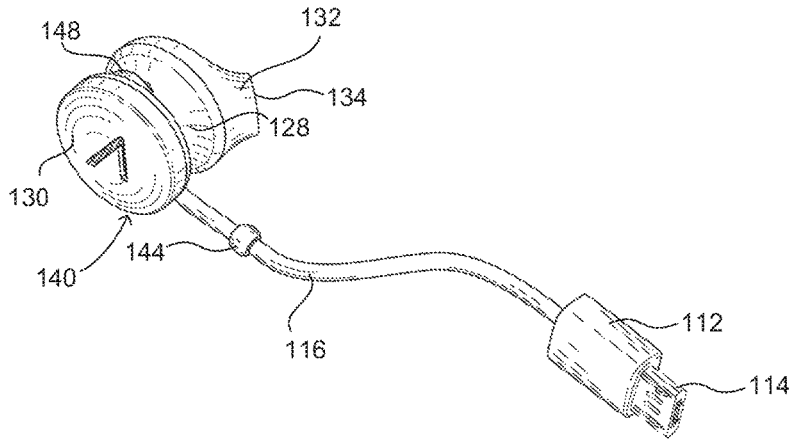
FIG. 11 shows an alternative headphone assembly according to an aspect of the present disclosure.
Figure 12:
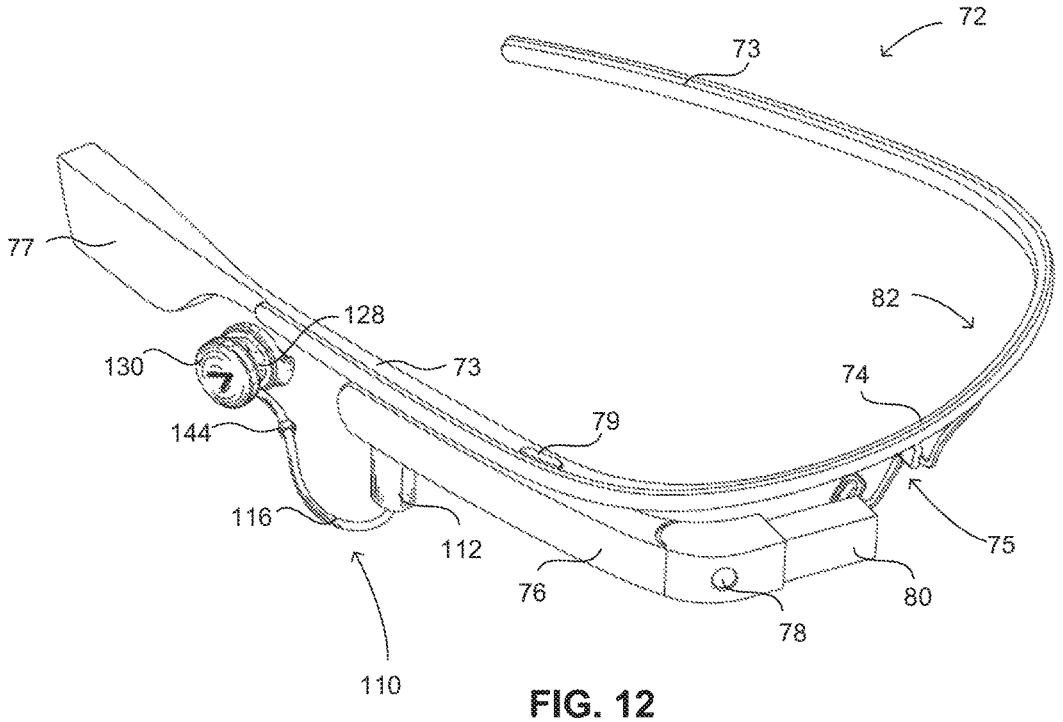
FIG. 12 shows an example of the headphone assembly of FIG. 11 in use with an example head-mountable display device.

Cable 18 can be relatively longer than cable 16. In an example, however, cable 16 can still be relatively shorter than what can be considered a typical length for headphone cable (which can be, for example, between 1 and 1.5 m from headphone to connection component). The length of cable 18 can take into account the fact that the audio source is positioned on the user's head (instead of, for example, the user's pocket). Accordingly, the length of cable 18 can be configured to comfortably extend around the user's head from the connection location of the plug housing 12 (i.e. along component housing 76) to the location of the left ear (or the right ear in the case of an HMD and corresponding headphone assembly that are mirror images of those shown in FIG. 10). In an example, cable 18 can be configured to be worn around the back of the user's head and/or neck, which can also be of an acceptable length to war toward the front of the user's neck (i.e. beneath the chin). Such a length can, for example, be between 200 and 300 mm In another example shown in FIG. 11, a headphone assembly 110 can include a plug housing 112 with a connection component 114 thereon that can be similarly configured to the various examples discussed above with respect to connection component 14. A single cable 116 can extend from plug housing 112 to a single headphone 120 that can also be similar in construction, fit, materials, and the like as discussed above with respect to headphone 20 (and the corresponding components and features thereof). For example, headphone 120 can include a channel 128 within body 126 thereof. A bridge 140 can similarly capture cable 116 therein such that it can slide through a similarly configured aperture 142 therein such that a loop (not shown) similar to loop 48' can be implemented and adjusted, as described above. Headphone assembly 110 can be similar in all general respects to headphone assembly 10, as described above, except that only a single headphone 120 is included therein. In the example shown, the single headphone 120 is configured (according to the configuration discussed above) to be a right headphone 120 such that headphone 120 can fit within the right ear and adjacent component housing 176 of HMD 72, as shown in FIG. 12. Cable 116 can be similarly relatively short in the manner of cable 16, as discussed with respect to FIG. 10, above, and can in an example be between 7 and 20 mm In another similar example, the single headphone can be configured as a left headphone and can be adapted to be used with an HMD that is generally a mirror image of the HMD 72 of FIG. 12.

In the example of headphone assembly 10, discussed above, the separate headphones 20 and 22 were described as being configured to present the respective left and right audio channels included in a stereo audio signal. However, in the example of FIGS. 11 and 12, wherein a single headphone is included, headphone assembly 110 can be configured to transmit a monaural signal to headphone 120. Such a monaural signal can be a native monaural signal, or can be combined or otherwise calculated or inferred from a two channel stereo signal. Such combining can be done by circuitry within headphone assembly 110 (such as within plug housing 112) or within HMD 72 (or other device with which assembly 110 is used). In an example HMD 72 can be configured to identify that a headphone assembly is being used therewith and can further identify that the headphone assembly 110 includes only a single headphone 120. In such a situation, the HMD 172 can transmit a monaural signal to headphone assembly 110. By way of example only, the headphone assembly 110 may include a mechanism to be automatically detected by the HMD 72. For example, a resistor of varying value may be employed. In this case, when circuitry of HMD 72 detects the presence of the headphone assembly 110, based on the resistor value, HMD 72 determines whether it is a mono headphone assembly or a stereo headphone assembly and transmit monaural or stereo signals accordingly.

Although the description herein has been made with reference to particular embodiments, it is to be understood that these embodiments are merely illustrative of the principles and applications of the present disclosure. It is therefore to be understood that numerous modifications may be made to the illustrative embodiments and that other arrangements may be devised without departing from the spirit and scope of the present disclosure as defined by the appended claims.

The invention claimed is:

1. A wearable audio component, comprising:

a first cable;

an audio generation source in electrical communication with the first cable; and a housing defining an interior and an exterior, the audio generation source being contained within the interior of the housing, and the exterior including an ear engaging surface, an outer surface, and a peripheral surface extending between the ear engaging surface and the outer surface, the peripheral surface including a channel open along a length thereof to surrounding portions of the peripheral surface, a portion of the channel being covered by a bridge member that defines an aperture between and open to adjacent portions of the channel, the bridge member extending continuously across the portion of the channel between the ear engaging surface and the outer surface;

wherein the first cable is of a fixed overall length and is connected with the housing at a first location disposed within the channel remote from the bridge member, and wherein the cable is captured in and extends through the aperture in a slidable engagement therewith, a first portion of the cable extending between the first location and the aperture such that an amount of the fixed overall length of the cable that is within the first portion can be varied by the slidable engagement.

2. The audio component of claim 1, wherein the amount of the fixed overall length of the first cable that is within the first portion can be varied by extension and contraction of a loop of the first cable that can be configured to extend outwardly from a portion of the channel between the first location and the aperture, and wherein such extension and contraction can be implemented by a user.

3. The audio component of claim 2, wherein the housing is receivable by portion of an outer ear of a wearer with a portion of the peripheral surface contacting a tragus of the ear and a portion of the ear engaging surface overlying an external auditory meatus of the ear, the housing further defining an audio port open to the interior of the housing and in communication with the audio generation source, the audio port being positioned at least within the portion of the ear engaging surface that overlies the external auditory meatus during wear, and wherein the loop is configured to be extendable so as to be positionable against a portion of a cavum of the ear opposite the external auditory meatus.

4. The audio component of claim 3, wherein the ear engaging surface includes a projection configured to extend into the external auditory meatus of the ear, the audio port being positioned on an end of the projection.

5. The audio component of claim 1, wherein the bridge creates an interference fit with the cable within the aperture.

6. The audio component of claim 1, wherein the channel extends radially around the peripheral surface outside of the bridge member.

7. The audio component of claim 6, wherein the peripheral surface defines a cylindrical profile in areas thereof outside of the channel.

8. The audio component of claim 1, wherein the ear engaging surface has a rounded shape at a first portion adjacent the peripheral surface and transitions into a projection, wherein when worn the projection is oriented toward a user's face.

9. The audio component of claim 8, wherein a first axis through the first portion is angled with respect to a second axis through the projection.

10. The audio component of claim 1, wherein the outer surface comprises a removable cap.

11. The audio component of claim 1, wherein an outer surface of the cable includes a texture contributing to an interference fit between the cable and the bridge.

12. A system, comprising:

a first headphone unit, comprising:

a first cable;

a first audio generation source in electrical communication with the first cable;

a first housing defining an interior and an exterior, the first audio generation source being contained within the interior of the first housing, and the exterior including an ear engaging surface, an outer surface, and a peripheral surface extending between the ear engaging surface and the outer surface, the peripheral surface including a channel open along a length thereof to surrounding portions of the peripheral surface, a portion of the channel being covered by a bridge member that defines an aperture between and open to adjacent portions of the channel, the bridge member extending continuously across the portion of the channel between the ear engaging surface and the outer surface;

wherein the first cable is of a fixed overall length and is connected with the first housing at a first location disposed within the channel remote from the bridge member, and wherein the first cable is captured in and extends through the aperture in a slidable engagement therewith, a first portion of the first cable extending between the first location and the aperture such that an amount of the fixed overall length of the first cable that is within the first portion can be varied by the slidable engagement; and a second headphone unit, comprising:

a second cable;

a second audio generation source in electrical communication with the second cable;

a second housing.

13. The system of claim 12, wherein the second housing defines an interior and an exterior, the second audio generation source being contained within the interior of the second housing, and the exterior including an ear engaging surface, an outer surface, and a peripheral surface extending between the ear engaging surface and the outer surface, the peripheral surface including a channel open along a length thereof to surrounding portions of the peripheral surface, a portion of the channel being covered by a bridge member that defines an aperture between and open to adjacent portions of the channel, the bridge member extending continuously across the portion of the channel between the ear engaging surface and the outer surface;

wherein the second cable is of a fixed overall length and is connected with the second housing at a second location disposed within the channel remote from the bridge member, and wherein the second cable is captured in and extends through the aperture in a slidable engagement therewith, a second portion of the second cable extending between the second location and the aperture such that an amount of the fixed overall length of the second cable that is within the second portion can be varied by the slidable engagement.

14. The system of claim 12, wherein the first cable and the second cable are coupled to a same connector.

15. The system of claim 14, wherein the connector is a universal serial bus connector.

16. The system of claim 14, wherein the first cable and the second cable have different fixed overall lengths.

17. The system of claim 13, wherein the ear engaging surface of each of the first and second headphone units has a rounded shape at a first portion adjacent the peripheral surface and transitions into a projection, wherein when worn the projection is oriented toward a user's face.

18. The system of claim 17, wherein for each of the first and second headphone units, a first axis through the first portion is angled with respect to a second axis through the projection.

* * * * *